United States Patent [19]

Matsukawa et al.

[11] 4,069,353

[45] Jan. 17, 1978

[54] PROCESS FOR PRODUCING DEVELOPER SHEET FOR PRESSURE-SENSITIVE RECORDING PAPER

[75] Inventors: Hiroharu Matsukawa; Takao Hayashi, both of Fujimiya, Japan

[73] Assignee: Fuji Photo Film Co., Ltd., Minami-ashigara, Japan

[21] Appl. No.: 613,787

[22] Filed: Sept. 16, 1975

Related U.S. Application Data

[63] Continuation of Ser. No. 159,567, July 2, 1971, abandoned.

[30] Foreign Application Priority Data

July 2, 1970 Japan ..... 45-57910

[51] Int. Cl.[2] ..... B41M 5/16

[52] U.S. Cl. ..... 427/57; 282/27.5; 427/150; 427/151; 427/391; 428/914

[58] Field of Search ..... 427/146, 150, 57, 151, 427/372, 384, 385, 391, 395; 282/27.5; 106/19–21; 428/323, 327, 411, 537, 913, 914

[56] References Cited

U.S. PATENT DOCUMENTS

| | | | |
|---|---|---|---|
| 3,516,845 | 6/1970 | Brockett | 260/42.43 X |
| 3,585,149 | 6/1971 | Vassiliades et al. | 260/2.5 B X |

*Primary Examiner*—Thomas J. Herbert, Jr.
*Assistant Examiner*—Bruce H. Hess
*Attorney, Agent, or Firm*—Sughrue, Rothwell, Mion, Zinn & Macpeak

[57] ABSTRACT

A process for producing a developer sheet for a pressure-sensitive recording paper which comprises dissolving an oil-soluble developer in an organic solvent, emulsifying the solution in water to provide an oil-in-water emulsion, and then coating on or incorporating into a support the resulting emulsion is disclosed.

12 Claims, No Drawings

PROCESS FOR PRODUCING DEVELOPER SHEET FOR PRESSURE-SENSITIVE RECORDING PAPER

This is a continuation of application Ser. No. 159,567, filed July 2, 1971, now abandoned.

This invention relates to a process for producing a developer sheet for a pressure-sensitive recording paper.

A pressure-sensitive recording paper utilizes the reaction between a substantially colorless organic compound (hereinafter referred to as color former) and a color developing substance (hereinafter referred to as a developer) capable of forming a colored product when contacted with each other. Specifically, the pressure-sensitive recording paper consists of a sheet (hereinafter referred to as a "color-former sheet") coated with microcapsules containing a solution of a color former in an organic solvent and a sheet (hereinafter referred to as a "developer sheet") coated with a developer and a binder. If necessary, the pressure-sensitive recording paper consists of the color-former sheet, the developer sheet and a sheet coated with the microcapsules on one surface thereof, and the developer on the other surface thereof. As another embodiment of the pressure-sensitive recording paper, there has been known a singlefold sheet on which both the microcapsule and the developer are coated.

Examples of the color former that can be used for this purpose include malachite green lactone [3,3-bis-(p-dimethylaminophenyl) phthalide], benzoyl leuco methylene blue, crystal violet lactone [3,3-bis-(p-dimethylaminophenyl)-6-dimethylamino phthalide], Rhodamine B lactam, 3-dialkylamino- 7-dialkylaminofluorans, and 3-methyl-2,2'-spirobi(benzo[f]chromene). As the developer, there has been known acid clay, activated clay, attapulgite, zeolite and bentonite. In recent years, oil-soluble developers such as phenolic resins have been proposed.

However, though the oil-soluble developer has some advantages, it causes some defects. For example, the developer sheet readily turns yellow on exposure to sunlight or air, especially when the oil-soluble developer is used in combination with a clay such as acid clay or activated clay which has a strong oxidizing power. Furthermore, since the oil-soluble developer is insoluble in water, it must be used by dissolving it in an organic solvent, or by mixing it with water and a binder by means of a ball mill, or by dispersing it in water and adding a binder to the dispersion. Therefore, such a coating composition can be applied only by limited types of applicators, and lends itself to poor working efficiency. With some types of solvent used, such a coating composition involves a risk of catching fire and consequent explosion. High cost is another setback of such types of coating composition. When used in a powdery form, the oil-soluble developer has defects such as reduced color-forming efficiencies.

An object of this invention is to provide an improved process for producing a developer sheet for pressure-sensitive recording paper. Another object of this invention is to provide a process for producing a developer sheet using oil-soluble developer for pressure-sensitive recording paper.

The above objects can be attained by coating the oil-soluble developer as a water-dispersible emulsion on a support. The water-dispersible emulsion of the oil-soluble developer used in this invention may be utilized, for example, (1) by directly coating it on a support, (2) by coating it on a support as a mixture with an inorganic substance such as clay, or (3) by impregnating it into a support in a process of manufacturing it.

All solvents can be used in the method, as long as they dossolve the oil-soluble developer and are immiscible with water without inhibiting the coloration of the color former. As examples of the solvents are isopropyl acetone, carbon tetrachloride, benzene, toluene, xylene, n-butyl acetate, diphenyl chloride and vegetable oils.

Examples of the oil-soluble developers used in the present invention are novolac-type phenol resins obtained by polycondensation between phenols and formalin in the presence of an acid catalyst, or alkyl phenol acetylene resins.

An oil-in-water type emulsion suitable for the production of the developer sheet of this invention is obtained by adding an emulsifier and a protective colloid to water, and gradually adding an organic solvent solution of the oil-soluble developer while stirring the system by a stirrer such as a homomixer which produces a high shearing force. The emulsification may also be performed by using an ultrasonic vibrator instead of the stirrer. As practical examples of emulsifiers are turkey red oil, an anionic surfactant such as alkyl sulfate, sulfated castor oil, olive oil soap, alkylbenzene sulfonate, sodium dibutyl-naphthalene sulfonate, lignin sulfonate or dialkyl sulfosuccinate, a cationic surfactant such as alkyl pyridinium chloride, alkyl trimethyl ammonium chloride or polyamines, a nonionic surfactant such as polyethylene glycol oleyl, polyethylene glycol oleyl ether, polyethylene glycol lauryl ether, polyethylene glycol nonylphenyl ether, sorbitan sesquioleate or sorbitan monooleate, and an amphoteric surfactant such as alkyl betain or alkyl imidazoline sulfurinate.

The protective colloid may contain gelatin, casein, gum arabic, alginic acid, polyvinyl alcohol or maleic anhydride styrene copolymer.

The resulting emulsion is coated on or impregnated into a support and then dried. If diphenyl chloride is used as the organic solvent, it remains in the support in a penetrated or impregnated state. Hence, it is unnecessary to calender the resulting sheet.

Further, conventional inorganic developers such as acid clay or activated clay may be added to the oil-in-water emulsion of the oil-soluble developer of this invention. In this case, inorganic substances may be added in the powder form or in the aqueous dispersion form.

The developer sheet so obtained may be used in combination with a color-former sheet. Otherwise, microcapsules containing a color former or color formers may be coated on this sheet.

According to the method of this invention, since an emulsion type coating composition of developer is used, the developer sheet is more simply produced without risk of explosion. Moreover, the cost of production can be reduced. When the developer sheet of the invention is used together with a color former, the color developing efficiency of the developer is increased.

The present invention will be described in greater detail by the following examples which are not intended in any way to limit the present invention. The color density and the yellowing (whiteness) were measured by the methods described below. In the examples, "part" refers to "parts by weight".

MEASUREMENT OF COLOR DENSITY

There was used a sheet produced by coating 6.0 g/m² of microcapsules containing 0.05 g/m² of crystal violet lactone as a color former, on raw paper having a unit weight of 40 g/m². The microcapsulecoated surface of the sheet was superimposed on the developer sheet to be tested, and pressure of 500 Kg/cm² was applied thereon. The density of the resulting colored mark was measured by a Beckman spectrophotometer.

MEASUREMENT OF YELLOWING

The surface of the developer sheet to be tested was exposed for 10 hours to an Atlas Fade-O-meter (500 W mercury lamp), and then the yellowing was measured by a Hunter's whiteness tester.

EXAMPLE 1

To a solution consisting of 50 parts of water, 1 part of sodium salt of casein and 1 part of 20% potassium hydroxide, 10 parts of a polycondensate, which was prepared by the reaction of paraphenyl phenol and formaldehyde in the presence of an acid catalyst and dissolved in 50 parts of diphenyl chloride, was added. The mixture was emulsified by an ultrasonic emulsifying device to a particle size of 0.1 to 0.5μ to form an oil-in-water emulsion.

Three hundred parts of water and 8 parts of 20% sodium hydroxide were placed in a 1000 cc beaker, and with stirring, 100 parts of activated clay (manufactured by Mizusawa Kagaku Kogyo K.K.) was gradually added and dispersed for 30 minutes. As binders, 15 parts, as solids content, of a styrene-butadiene latex (Trade name: Dow Latex 620, manufactured by Dow Chemical Company) and 50 parts of 10% aqueous solution of sodium salt of casein were further added to form a dispersion of activated clay.

The emulsion obtained above was added in an amount of 112 parts to this dispersion of activated clay to form a coating composition. The coating composition was coated on paper having a unit weight of 40 g/m² at a rate of 10 g/m² as solids content, and dried to form a developer sheet.

To form a developer sheet for comparative purposes, the following procedure was followed. In a 1,000 cc beaker, 300 parts of water and 8 parts of 20% sodium hydroxide were introduced. With stirring, 100 parts of activated clay (manufactured by Mizusawa Kagaku Kogyo K.K.) was gradually added, and then 10 g of powders (passing through a 325-mesh sieve) of a phenol resin were added and dispersed for 30 minutes. As binders, 15 parts, as solids content, of a styrene-butadiene latex (Trade name: Dow Latex 620, manufactured by Dow Chemical Company) and 50 parts of 10% aqueous solution of sodium salt of casein were further added to form a coating composition. The coating composition was coated on paper having a unit weight of 40 g/m² at a rate of 10 g/m² as solids content, and dried to form a developer sheet.

Each of the developer sheets obtained above was superimposed on a sheet coated with microcapsules containing crystal violet lactone as a color former, and pressurized by pressure of 500 Kg/cm² to form color images. The color density at a maximum absorption wavelength of 600 mμ was measured.

Furthermore, the surface of each developer sheet was exposed for 10 hours to an Atlas Fade-O-meter (500 W mercury lamp), and the discoloration was measured by a Hunter's whiteness meter. The results obtained are given in Table 1 below.

TABLE 1

| | Sheet of the invention | Sheet for comparison |
|---|---|---|
| Density of color (degree of light absorption) | 1.35 | 1.13 |
| Whiteness | 65 | 60 |

As described above, by dispersing uniformly the emulsion of the phenol resin in the dispersion of clay, color developing ability of the developer sheet was increased, and the color change of the developer sheet was less upon exposure to light. Also, the color of crystal violet lactone formed on the developer sheet of the invention was superior in water resistance (that is, a reduction in the color density when the sheet was wetted with water) to that formed on the comparative developer sheet.

The operability of the developer sheet is excellent because an aqueous coating composition can be obtained.

EXAMPLE 2

To a solution consisting of 50 parts of water, 1 part of sodium salt of casein and 1 part of 20% potassium hydroxide, a solution of 20 parts of paraphenylphenol formaldehyde resin in 50 parts of toluene was gradually added while applying ultrasonic vibration. Thus, the phenol resin was emulsified until its particle size reached 0.1 to 0.5μ. The resulting emulsion was coated on paper having a unit weight of 40 g/m² at a rate of 2 g/m² calculated as the solids content of the phenol resin, and dried to form a developer sheet.

To form a developer sheet for comparative purposes, a solution of 20 parts of paraphenylphenol formaldehyde resin in 50 parts of toluene was coated on paper having a unit weight of 40 g/m² at a rate of 2 g/m² calculated as the solids content of the phenol resin, and dried to form a developer sheet.

The same tests as set forth in Example 1 were performed on the resulting developer sheets, and the results obtained are shown in Table 2.

TABLE 2

| | Sheet of the invention | Sheet for comparison |
|---|---|---|
| Density of color (degree of light absorption) | 1.25 | 1.12 |
| Whiteness | 66 | 65.4 |

In the developer sheet of this invention, the phenol resin remains on the surface of the paper without being absorbed by the paper, and therefore, the color-developing ability of the phenol resin was effectively utilized.

There was hardly any influence on the yellowing at the time of exposure to light. The operability in Example 2 was better than that in Example 1.

EXAMPLE 3

To a solution consisting of 50 parts of water, 10 parts of soduim salt of casein and 1 part of 20% potassium hydroxide, a solution of 20 parts of paraphenylphenol formaldehyde resin in 50 parts of n-butyl acetate was gradually added while applying ultrasonic vibration. Thus, the phenol resin was emulsified until its particle size reached 0.1 to 0.5μ, to form a water-dispersible emulsion.

The resulting emulsion was added to a slurry of paper stock of 100% wood sulfite pulp beaten to 40 SR in an amount such that 10 parts of the phenol resin were present per 100 parts of the dried pulp. One part of melamine formaldehyde resin, 2 parts of maleic acid-modified resin size and 2 parts of alumina sulfate were further added. The paper stock so obtained was made into a sheet having a unit weight of 50 g/m² on an ordinary Fourdrinier machine, and dried by a multicylinder type drier, thereby forming a developer sheet containing the emulsion of the phenol resin.

To form a developer sheet containing the phenol resin for comparative purposes, 10 parts of fine powders of paraphenylphenol formaldehyde resin (the powders passing through a 325-mesh sieve), based on 100 parts of dried pulp, were added to a slurry of 100% wood sulfite pulp beaten to 40 SR, and 1 part of melamine formaldehyde resin, 2 parts of maleic acid-modified resin size and 2 parts of alumina sulfate were further added. The paper stock so obtained was made into a sheet having a unit weight of 50 g/m² on an ordinary Fourdrinier machine, and dried by a multicylinder type drier.

The same tests as set forth in Example 1 were performed on the sheets obtained above, and the results are given in Table 3.

TABLE 3

| | Sheet of the invention | Sheet for comparison |
|---|---|---|
| Density of color (degree of light absorption) | 1.02 | 0.88 |
| Whiteness | 68 | 65 |

It can be seen from the results that the sheet of this invention was higher in color developing ability and had a somewhat lesser degree of discoloration.

While the invention has been particularly shown and described with reference to a preferred embodiment thereof, it will be understood by those skilled in the art that various changes in form and details may be made therein without departing from the spirit and scope of the invention.

What is claimed is:

1. A process for producing a developer sheet for a pressure-sensitive recording paper which comprises:

forming an oil-in-water emulsion which consists essentially of an oil-soluble color developer which reacts with a colorless organic compound to form a colored product selected from the group consisting of novolactype phenol resins and phenol acetylene resins, a water-immiscible organic solvent for said oil-soluble color developer, water and at least one member selected from the group consisting of an emulsifier and a protective colloid, by adding said member to water and thereafter adding thereto and emulsifying therein a solution of said color developer in said organic solvent;

coating the resulting oil-in-water emulsion on or incorporating the resulting oil-in-water emulsion in a support; and drying to form said developer sheet.

2. The process according to claim 1 wherein said emulsion is coated on the support together with an inorganic substance.

3. The process according to claim 2 wherein said inorganic substance is acid clay or activated clay.

4. The process according to claim 1 wherein said emulsion is incorporated in a paper stock, and the developer sheet is made therefrom.

5. The process according to claim 1 wherein said oil-soluble developer is a novolac-type phenol resin.

6. The process according to claim 1 wherein said oil-in-water emulsion contains both of said emulsifier and said protective colloid.

7. The process according to claim 6 wherein said emulsifier is selected from the group consisting of turkey red oil, and a surfactant selected from the group consisting of anionic, cationic, nonionic and amphoteric surfactants.

8. The process according to claim 6 wherein said protective colloid is selected from the group consisting of gelatin, casein, gum arabic, alginic acid, polyvinyl alcohol and a maleic anhydride-styrene copolymer.

9. The process according to claim 6 wherein said emulsifying is accomplished by adding said solution with agitation.

10. The process according to claim 6 wherein said emulsifying is accomplished by adding said solution while applying thereto ultrasonic waves.

11. The process according to claim 6 wherein said water-immiscible organic solvent is selected from the group consisting of isopropyl acetone, carbon tetrachloride, benzene toulene, xylene, n-butyl acetate, diphenyl chloride and vegetable oils.

12. The process according to claim 1 wherein said phenol acetylene resin is an alkyl phenol acetylene resin.

* * * * *